US005692883A

United States Patent [19]

Vourc'h

[11] Patent Number: 5,692,883

[45] Date of Patent: Dec. 2, 1997

[54] COMPACT ELECTRO-HYDRAULIC UNIT

[75] Inventor: Jean-Yves Ollivier Vourc'h, Rueil-Malmaison, France

[73] Assignee: Hydroperfect International, Chenneviers Sur Marne, France

[21] Appl. No.: 693,982

[22] Filed: Aug. 8, 1996

[30] Foreign Application Priority Data

Aug. 30, 1995 [FR] France ..... 95 10219

[51] Int. Cl.[6] ..... F04B 39/00

[52] U.S. Cl. ..... 417/312; 418/181

[58] Field of Search ..... 417/312, 540; 418/206.1, 181; 181/403, 204, 269, 272

[56] References Cited

U.S. PATENT DOCUMENTS

| | | | |
|---|---|---|---|
| 3,121,529 | 2/1964 | Hubrich | 417/540 |
| 4,174,196 | 11/1979 | Mori et al. | 418/181 |
| 4,486,160 | 12/1984 | Lipscombe | 417/540 |
| 4,557,678 | 12/1985 | Nishimura | 417/540 |
| 4,752,195 | 6/1988 | Friedrich et al. | 417/540 |
| 5,401,150 | 3/1995 | Brown | 418/181 |
| 5,507,151 | 4/1996 | Ring et al. | 181/403 |

FOREIGN PATENT DOCUMENTS

| | | |
|---|---|---|
| 0 088 684 | 9/1983 | European Pat. Off. . |
| 0 541 337 A1 | 5/1993 | European Pat. Off. . |
| 29 22 731 | 12/1980 | Germany . |
| 3438 680 A1 | 5/1985 | Germany . |
| 2 036 873 A | 7/1980 | United Kingdom . |
| 86/04393 | 7/1986 | WIPO . |

*Primary Examiner*—Timothy Thorpe
*Assistant Examiner*—Peter G. Korytnyk
*Attorney, Agent, or Firm*—Kirschstein, et al.

[57] ABSTRACT

A compact electro-hydraulic unit in which an electric motor drives an hydraulic pump having pinions and a pump body, with a cavity containing the pinions, the pump body comprising sound wave absorbing cavities surrounding at least partially the cavity containing the pinions. Some at least of the cavities communicate, by means of a side surface of the pump body, with a chamber of a cover leading to a fitting of a utilization circuit and with an outlet of the cavity containing the pinions, the cavities being supplied with a hydraulic fluid under high pressure.

24 Claims, 4 Drawing Sheets

COMPACT ELECTRO-HYDRAULIC UNIT

FIELD OF THE INVENTION

The invention relates to electro-hydraulic units in which an electric motor drives a hydraulic pump for feeding various utilization circuits.

PURPOSE AND SUMMARY OF THE INVENTION

The invention relates more particularly to an electro-hydraulic unit designed to feed hydraulic receivers such as those used in the automobile industry and in particular for aiding in the steering of these vehicles.

This invention relates still more particularly to so called compact units which are sealed-tight units in which an assembly made of a hydraulic pump and a motor is contained in a sealed-tight casing which is also used as a tank for the hydraulic fluid.

It has been found that, for permitting an easy positioning of the hydraulic assembly in automobile vehicles, the hydraulic assembly should be made as compact as possible for being located in a casing of a small volume that can be easily mounted in available places under a hood of the motor of a vehicle.

Moreover, the invention is able to reduce, and even cancel, noises resulting from the working of an electro-hydraulic unit and provides that, in case of a breakdown of the electric circuit of the vehicle, the presence of the electro-hydraulic control unit does not prevent a free control of the servo-circuit, in particular of the steering circuit of the vehicle.

According to the invention, the compact electro-hydraulic unit in which an electric motor drives a hydraulic pump having pinions and a pump body, with a cavity containing said pinions, said pump body comprising sound wave absorbing cavities surrounding at least partially said cavity containing said pinions, wherein some at least of said cavities communicate, by means of a side surface of the pump body, with a chamber of a cover leading to a fitting of a utilization circuit.

Various other features of the invention are moreover revealed from the following detailed disclosure.

SHORT DESCRIPTION OF THE DRAWINGS

Embodiments of the invention are shown, as non limitative examples, in the accompanying drawings, wherein.

DETAILED DISCLOSURE OF THE INVENTION

Figure 2:
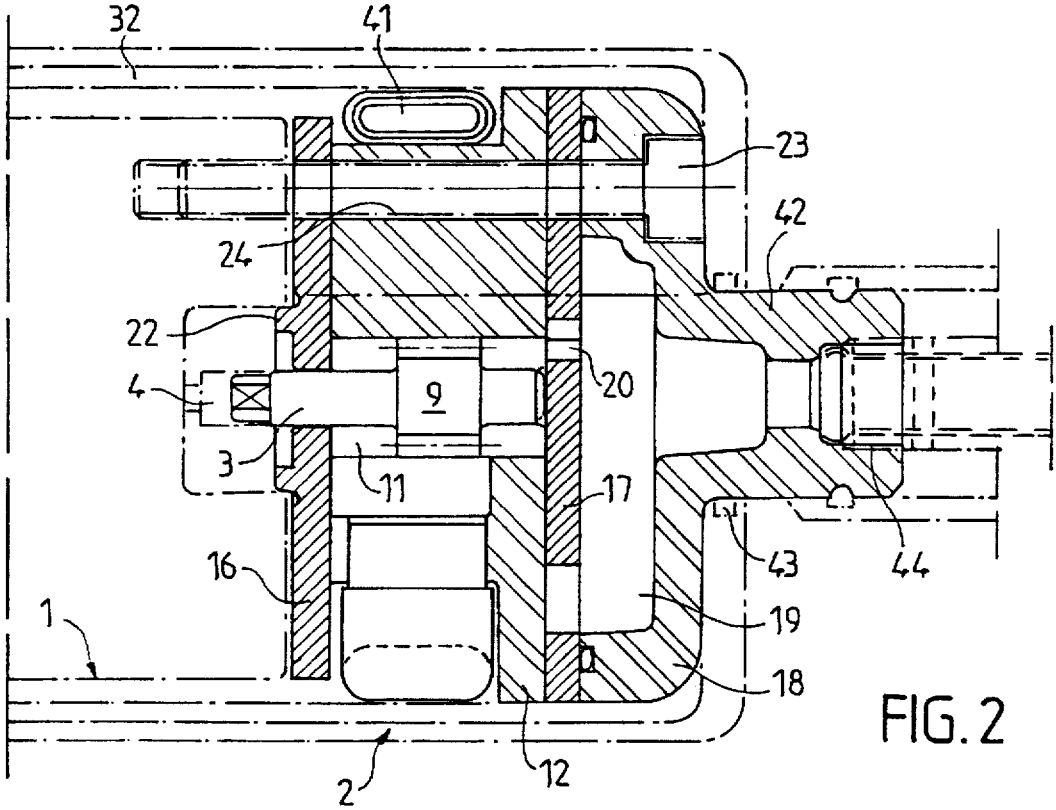
FIG. 2 is a cross-section, similar to FIG. 1, but taken along line II—II of FIG. 4.

Referring now to the drawings, the motor-pump unit of the invention comprises an electric motor 1, only diagrammatically shown by the casing thereof, and a hydraulic pump generally shown at 2, the input shaft 3 of which is driven by the motor 1 through a coupling 4.

The input shaft 3, as well as the driven shaft 5 of the pump 2, are mounted in bearing members 6, 7 that are movable with respect to the above mentioned shafts 3 and 5 by means of a so called hydrostatic compensation device, the sealing members 8 of which only are shown.

Hydrostatic compensation devices being well known in the art of hydraulic pumps and motors, are not described more in detail in the present specification.

The shafts 3 and 5 are provided with engaged pinions 9, 10 located in a cavity 11 of a pump body 12.

The pump body 12 is a unitary part made, for example of aluminum alloy and is formed, on both sides of the cavity 11, with two through holes 13, 14 for the positioning of tightening bolts 15. The bolts 15 maintain the side cheeks 16, 17 on the two sides of the pump body 12, and provide a compact pump outside the assembly of the pump with the motor.

The side cheeks 16, 17 are made of a material having a high resiliency modulus, for example steel, and having a thickness that is as small as possible taking into account the forces to which they are subjected.

Figure 3:
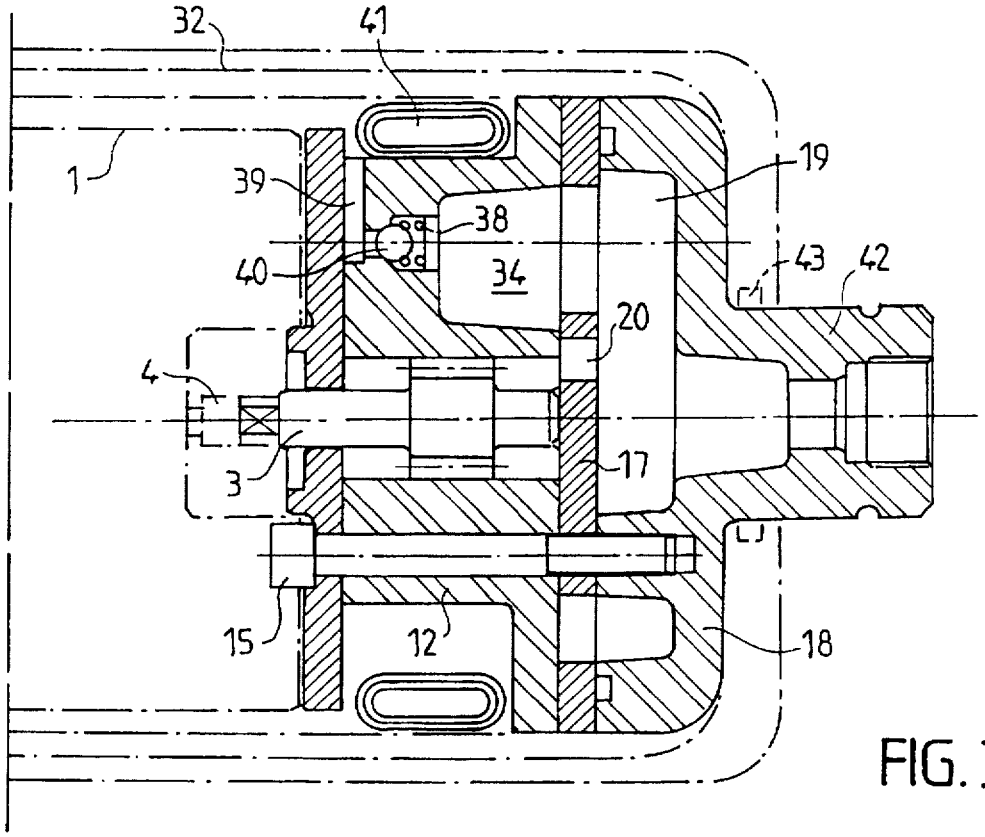
FIG. 3 is a cross-section, similar to FIGS. 1–2, but taken along line III—III of FIG. 4.
Figure 4:
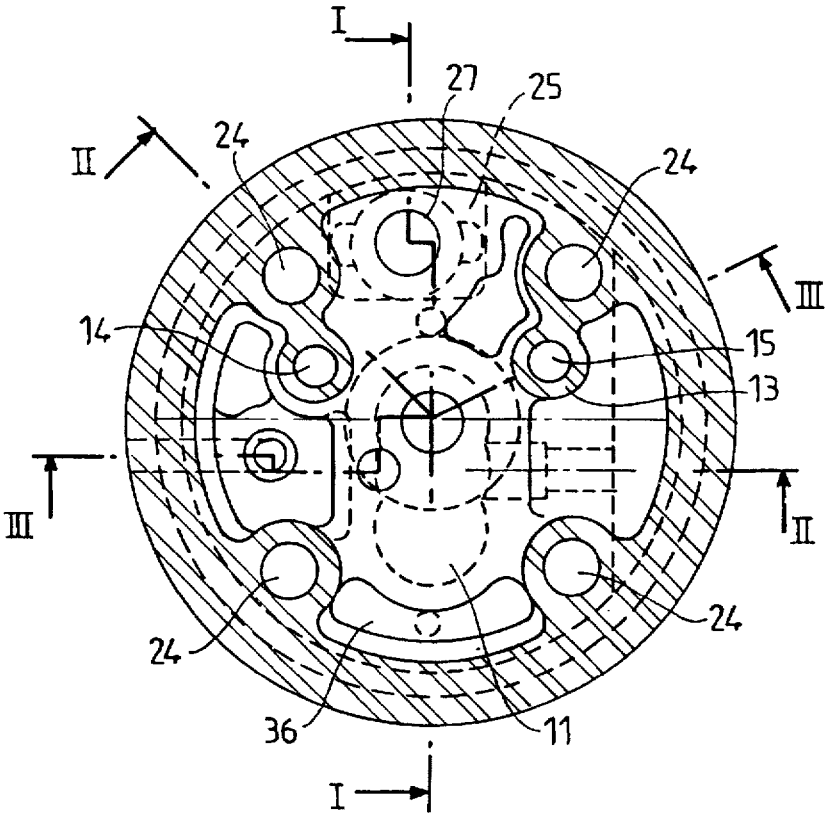
FIG. 4 is a cross-section taken along line IV—IV of FIG. 1.

FIG. 3 shows that tightening bolts 15 will provide the junction, not only of the cheeks 16, 17 on both sides of the pump body 12 as well as the fixation of a cover 18 delimiting, opposite the cheek 17, a chamber 19 in which the high pressure fluid, driven back by the pinions 9, 10, is brought through an aperture 20 in the cheer 17.

Figure 5:
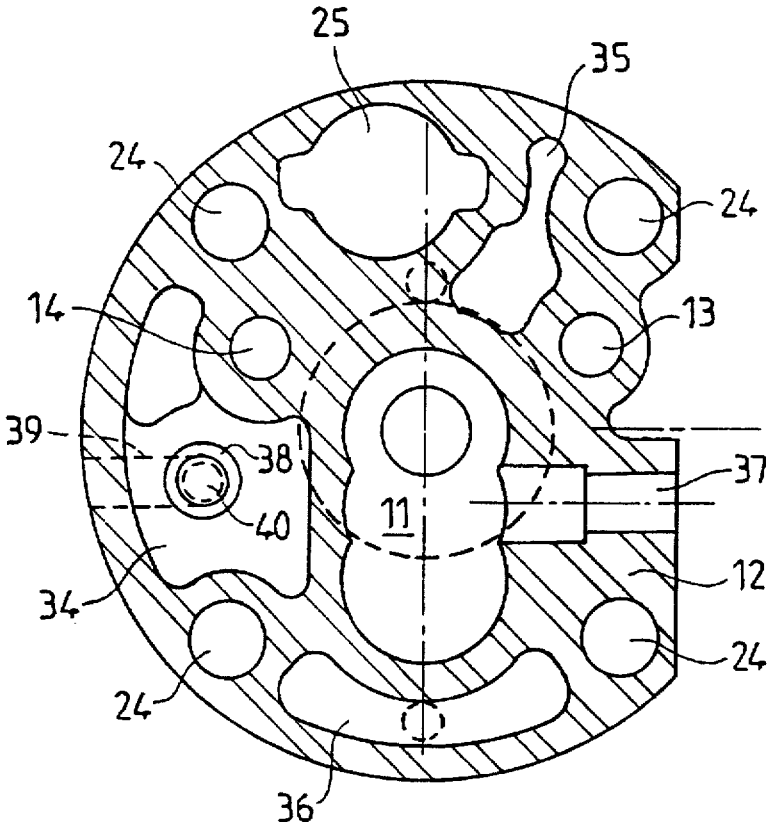
FIG. 5 is a cross-section taken substantially along line V—V of FIG. 1.
Figure 6:
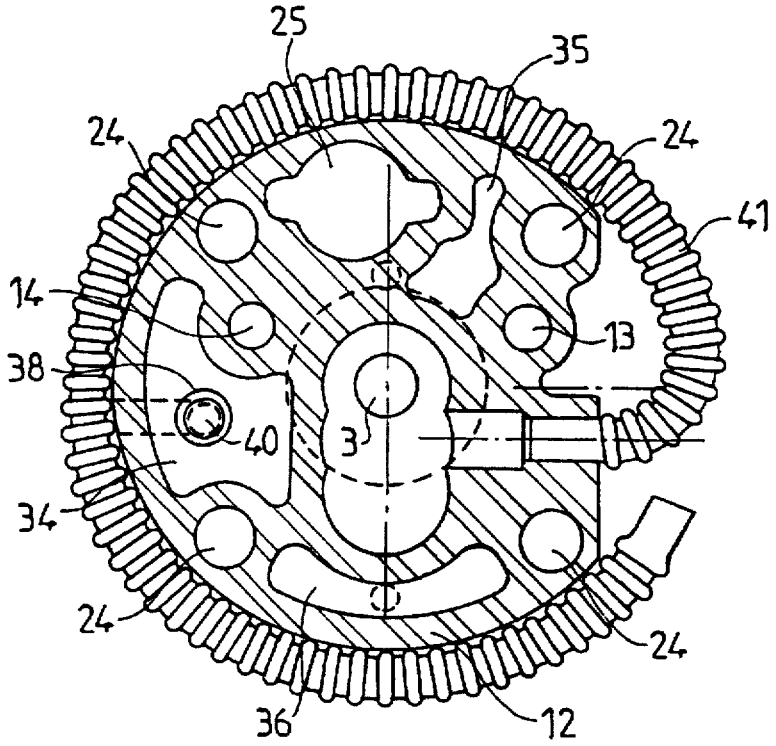
FIG. 6 is a view, similar to FIG. 5, but illustrating a further feature of the invention.

The cheek 16 maintained by the tightening bolts 15 is, moreover, centered on the pump body 12 by means of studs 21, and the free side of the cheek 16 is formed with a protruding ring 22 for centering the motor 1 which is attached to the pump body 12 by means of bolts 23 passed through holes 24 of the pump body 12, these holes 24 as well as the bolts 23 being shown in particular in FIGS. 2, 5 and 6.

The pump body 12 is formed, between the cavity 11 containing the pinions 9, 10 and its periphery, with a housing 25 crossing through the pump body 12 and in which is arranged the cartridge 26 of an over pressure flap valve 27 (FIG. 1) having a piston 28 which is biased by a calibration spring 29 and communicates through a bore 30 with the chamber 19 in which the high pressure fluid is driven back.

Figure 1:
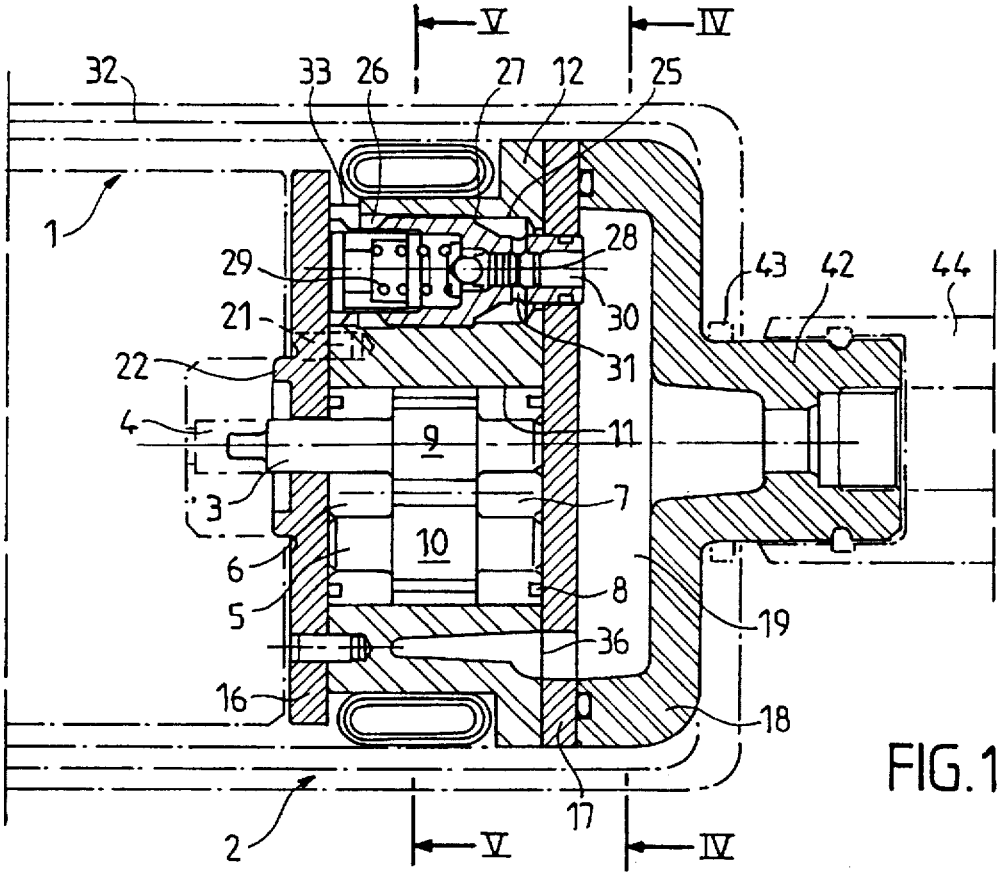
FIG. 1 is a partial and partly diagrammatic cross-sectional elevation view, of the compact electro-hydraulic unit of the invention, taken along line I—I of FIG. 4.

FIG. 1 shows that the over pressure flap valve 27 crosses through the cheek 17.

The piston 28 of the over pressure flap valve 27 controls an opening of discharge channels 31 leading to the inside of the cavity 25 which communicates with the inside of a tank casing 32 through an aperture 33 (FIG. 1).

The pump body 12 is formed, in its side facing the cheek 17, with cavities such as 34, 35 and 36 that surround the cavity 11 containing the pinions 9, 10 of the pump 2. These cavities, which communicate with the high pressure fluid chamber 19, define a set of cavities for absorbing the sound waves generated by the working of the pump.

If desired, some at least of the sound wave absorbing cavities 34, 35, 36 may be connected together to circulate the high pressure fluid that they contain.

The pump body 12 comprises an inlet duct 37 which leads to the cavity 11 containing the pinions 9, 10 (FIG. 5) and which opens to the inside of the casing 32 that is filled with low pressure fluid.

The pump body 12 defines a channel 38 opening in one of the so called Helmholtz cavities, in this case the cavity 34, and leading by a duct 39 to the inside of the casing 32.

A back flow preventing flap valve 40 is formed by a ball, a spring and a retaining element which is arranged in the channel 38 and which is maintained on its seat by the pressure prevailing in the cavity 34 that communicates with the chamber 19 of the cover 18.

Since the channel 38 and the back flow preventing flap valve 40 constitute a path for the fluid between the low and high pressure circuits, it is possible to use a fluid receiving mechanism in case of a breakdown in the supply of the electric motor driving the pump. Actually, the circulation between the low and high pressure circuits which may be made through the back flow preventing flap valve 40 prevents a blockage as this could occur concerning the receiving mechanism which could not be manually controlled if the high pressure circuit cannot be fed by the low pressure circuit.

Alternately, it has been found advantageous, as shown in FIG. 6, to provide a flexible duct, for example a ringed duct 41 surrounding the pump body 12 and connecting the inlet duct 37 to the inside of the casing 32.

The duct 41 improves the absorption of the sound waves generated by the working of the pump.

As shown from the above disclosure, the pump 2 has a great compactness since the pump body 12, which is closed by the thin cheeks, itself defines all the cavities that are necessary for the positioning of the pinions as well as the absorption chambers, the over pressure flap valve and the inlet and outlet ducts, thereby providing a very great compactness to the assembly.

Moreover, concerning the mounting operation, it is very much simplified by the above described embodiment.

Actually, after having positioned the pinions 9, 10 in their bearing members 6, 7 and positioned the over pressure flap valve 27 and the back flow preventing flap valve 40, the cheeks 16, 17 are tightened on the lateral sides of the pump body 12 by means of the tightening bolts 15 which provides simultaneously the tightening and attachment of the cover 18 that defines the high pressure chamber 19.

The hydraulic assembly thus constitutes a unitary structure to which the electric motor 1 is then secured by positioning the bolts 23, which contributes to ensure the seal tightness functions of the pump 2 as shown by FIG. 2. The assembly made by the hydraulic unit and the hydraulic motor is then engaged within the casing 32.

It is advantageous, as shown in FIGS. 1–3, that the cover 18 form a connector 42 on which the casing 32 is engaged, the seal tightness being provided by an O-ring gasket 43. The connector 42 is preferably provided so as to permit a quick connection with the fixation support. The tapped bore 44 enables fixation of a feeding pipe of a receiver 44.

Figure 7:
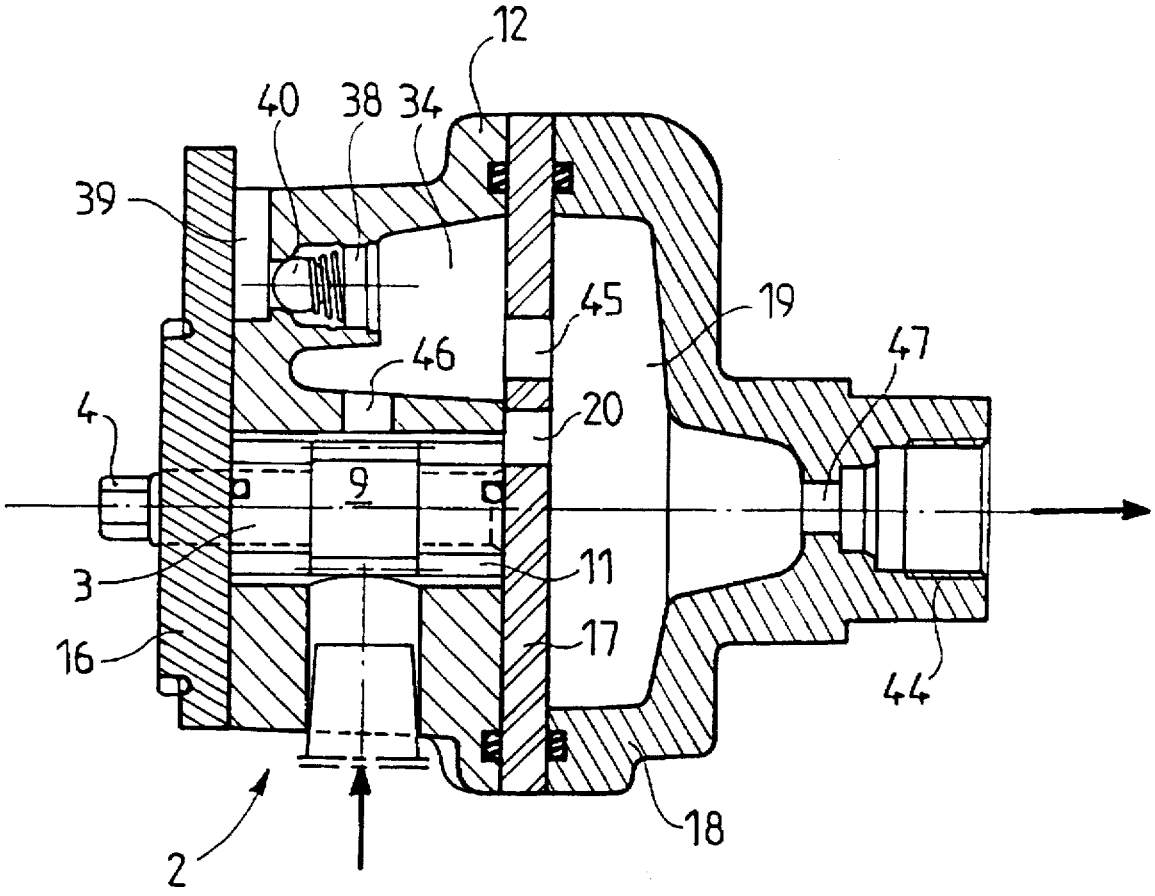
FIG. 7 is a partial cross-sectional elevation view, similar to FIG. 3, of the pump of the electro-hydraulic unit illustrating an embodiment of the invention.

The embodiment according to FIG. 7 shows that the cheek 17 defines two chambers 19 and 34. The pump discharges in the chambers 19 and 34 by calibrated channels 20, 45 and 46, the channel shown at 20 corresponding to the properly so called back drive of the pump.

The flow is then made by the high pressure outlet of the bore 44 through a further calibrated channel 47.

The distribution of volume into two high pressure chambers 19 and 34 permits, by adjusting the channels or apertures 20, 45, 46 and 47, to reduce the pressure pulses generated by the pinions, which pressure pulses are thus absorbed because of the multiple communications made between the absorbing cavities and between the back driving parts of the pinions and the absorbing cavities.

What I claim is:

1. A compact electro-hydraulic unit, comprising:

a) a drive motor;

b) a hydraulic pump driven by the motor about an axis, said pump including i) a pump body having a periphery and a main cavity extending along the axis between opposite sides of the pump body, ii) an inlet in communication with the main cavity for admitting a low pressure fluid to the main cavity, iii) a set of pinions mounted in the main cavity for pressurizing the low pressure fluid to a high pressure fluid, iv) an outlet in communication with the main cavity for discharging the high pressure fluid from the main cavity during pressurizing, and v) a plurality of sound absorption cavities located within the pump body between the periphery and the axis, and at least partially surrounding the main cavity;

c) a cover mounted on the pump and having an internal chamber in communication with at least one of the cavities and the outlet for receiving the high pressure fluid, said cover having a fitting for connection to a hydraulic receiver for conveying the high pressure fluid received in the internal chamber to the receiver; and d) a housing located within the pump body between the periphery and the axis, and containing an over-pressure cartridge in communication with the internal chamber of the cover.

2. The electro-hydraulic unit as set forth in claim 1, wherein at least one of the sound absorption cavities is formed by two chambers separated by a cheek located between the cover and the pump body, said cheek being provided with channels.

3. The electro-hydraulic unit as set forth in claim 1, wherein pressure pulses are generated by the pump; and further comprising calibrated apertures in communication with the outlet and at least one of the sound absorption cavities, for reducing said pressure pulses.

4. The electro-hydraulic unit as set forth in claim 1, wherein the inlet extends into the pump body from a casing that forms a tank containing the pump and electric motor.

5. The electro-hydraulic unit as set forth in claim 1, wherein the fitting has an O-ring gasket.

6. The electro-hydraulic unit as set forth in claim 5, wherein the hydraulic receiver is a feeding pipe.

7. A compact electro-hydraulic unit, comprising:

a) a drive motor;

b) a hydraulic pump driven by the motor about an axis, said pump including i) a pump body having a periphery and a main cavity extending along the axis between opposite sides of the pump body, ii) an inlet in communication with the main cavity for admitting a low pressure fluid to the main cavity, iii) a set of pinions mounted in the main cavity for pressurizing the low pressure fluid to a high pressure fluid, (iv) an outlet in communication with the main cavity for discharging the high pressure fluid from the main cavity during pressurizing, and v) a plurality of sound absorption cavities located within the pump body between the periphery and the axis, and at least partially surrounding the main cavity;

c) a cover mounted on the pump and having an internal chamber in communication with at least one of the cavities and the outlet for receiving the high pressure fluid, said cover having a fitting for connection to a hydraulic receiver for conveying the high pressure fluid received in the internal chamber to the receiver; and d) a back-flow preventing flap valve mounted in a channel formed within the pump body, said channel having one end in communication with at least one of said sound absorption cavities, and an opposite end in communication with a duct leading to a low pressure zone.

8. The electro-hydraulic unit as set forth in claim 7, wherein at least one of the sound absorption cavities is formed by two chambers separated by a cheek located between the cover and the pump body, said cheek being provided with channels.

9. The electro-hydraulic unit as set forth in claim 7, wherein pressure pulses are generated by the pump; and further comprising calibrated apertures in communication with the outlet and at least one of the sound absorption cavities, for reducing said pressure pulses.

10. The electro-hydraulic unit as set forth in claim 7, wherein the inlet extends into the pump body from a casing that forms a tank containing the pump and electric motor.

11. The electro-hydraulic unit as set forth in claim 10, wherein the inlet is connected to a duct surrounding the pump body and in communication with the inside of said casing that contains the low pressure fluid.

12. The electro-hydraulic unit as set forth in claim 7, wherein the fitting has an O-ring gasket.

13. The electro-hydraulic unit as set forth in claim 12, wherein the hydraulic receiver is a feeding pipe.

14. A compact electro-hydraulic unit, comprising:

a) a drive motor;

b) a hydraulic pump driven by the motor about an axis, said pump including i) a pump body having a periphery and a main cavity extending along the axis between opposite sides of the pump body, ii) an inlet in communication with the main cavity for admitting a low pressure fluid to the main cavity, iii) a set of pinions mounted in the main cavity for pressurizing the low pressure fluid to a high pressure fluid, iv) an outlet in communication with the main cavity for discharging the high pressure fluid from the main cavity during pressurizing, and v) a plurality of sound absorption cavities located within the pump body between the periphery and the axis, and at least partially surrounding the main cavity;

c) a cover mounted on the pump and having an internal chamber in communication with at least one of the cavities and the outlet for receiving the high pressure fluid, said cover having a fitting for connection to a hydraulic receiver for conveying the high pressure fluid received in the internal chamber to the receiver; and d) a pair of side cheeks at said opposite sides of the pump body, said cheeks having bearings for supporting the pinions, and also having sealing members for hydrostatic compensation devices.

15. The electro-hydraulic unit as set forth in claim 14; and further comprising bolts for interconnecting the pump body, the cheeks and the cover as a unitary structure, and also comprising centering studs for centering the pump body relative to at least one of the cheeks.

16. The electro-hydraulic unit as set forth in claim 15; and further comprising a centering ring on one of the cheeks, for centering the pump and the motor on said axis, and wherein the bolts fixedly engage the motor.

17. The electro-hydraulic unit as set forth in claim 14, wherein the cheeks are constituted of a high strength steel.

18. The electro-hydraulic unit as set forth in claim 14, wherein at least one of the sound absorption cavities is formed by two chambers separated by a cheek located between the cover and the pump body, said cheek being provided with channels.

19. The electro-hydraulic unit as set forth in claim 14, wherein pressure pulses are generated by the pump; and farther comprising calibrated apertures in communication with the outlet and at least one of the sound absorption cavities, for reducing said pressure pulses.

20. The electro-hydraulic unit as set forth in claim 4, wherein the inlet is connected to a duct surrounding the pump body and in communication with the inside of said casing that contains the low pressure fluid.

21. The electro-hydraulic unit as set forth in claim 14, wherein the inlet extends into the pump body from a casing that forms a tank containing the pump and electric motor.

22. The electro-hydraulic unit as set forth in claim 21, wherein the inlet is connected to a duct surrounding the pump body and in communication in the inside of the said casing that contains the low pressure fluid.

23. The electro-hydraulic unit as set forth in claim 14, wherein the fitting has an O-ring gasket.

24. The electro-hydraulic unit as set forth in claim 23, wherein the hydraulic receiver is a feeding pipe.

* * * * *